US007773084B2

(12) United States Patent
Itakura et al.

(10) Patent No.: US 7,773,084 B2
(45) Date of Patent: Aug. 10, 2010

(54) IMAGE DISPLAY DEVICE, IMAGE DISPLAY PANEL, PANEL DRIVE DEVICE, AND METHOD OF DRIVING IMAGE DISPLAY PANEL

(75) Inventors: Naoyuki Itakura, Kanagawa (JP); Hiroaki Ichikawa, Kanagawa (JP); Toshikazu Maekawa, Kanagawa (JP)

(73) Assignee: Sony Corporation, Tokyo (JP)

( * ) Notice: Subject to any disclaimer, the term of this patent is extended or adjusted under 35 U.S.C. 154(b) by 715 days.

(21) Appl. No.: 10/568,538

(22) PCT Filed: Aug. 20, 2004

(86) PCT No.: PCT/JP2004/012308

§ 371 (c)(1),
(2), (4) Date: Jun. 25, 2007

(87) PCT Pub. No.: WO2005/020206

PCT Pub. Date: Mar. 3, 2005

(65) Prior Publication Data

US 2008/0136810 A1 Jun. 12, 2008

(30) Foreign Application Priority Data

Aug. 22, 2003 (JP) ..... 2003-298661

(51) Int. Cl.
*G06G 3/038* (2006.01)

(52) U.S. Cl. ..... 345/215; 345/94

(58) Field of Classification Search ..... 345/215, 345/94, 204, 96, 92, 100
See application file for complete search history.

(56) References Cited

U.S. PATENT DOCUMENTS 5,648,793 A * 7/1997 Chen ..... 345/96

(Continued)

FOREIGN PATENT DOCUMENTS

EP 1 069 457 A1 1/2001

(Continued)

OTHER PUBLICATIONS

PCT International Search Report for PCT/JP2004/012308 mailed on Oct. 26, 2004.

(Continued)

*Primary Examiner*—Amare Mengistu
*Assistant Examiner*—Yuk Chow
(74) *Attorney, Agent, or Firm*—Rader, Fishman & Grauer PLLC

(57) ABSTRACT

In the present invention, during an 1H period excluding a blanking period (1HB) constituting a line display period, pixel data pulses of RGB (61B to 61R) are successively supplied for each color to corresponding signal lines for the color display of one pixel line. A control circuit (40) of select switches connected to the signal lines (6-1 to **6-*n*) supplies permission pulses (63B to 63R) for the supply of data to signal lines when displaying one color among RGB to select switches (TMG), and turns on the select switch (TMG) of the signal line corresponding to another color to be displayed later in the same line display period during the period of this application by a precharge pulse (62G or 62R) having a time duration shorter than the supply time of the pixel data of the other color (T2 or T3**) to previously precharge the signal line of the other color to the predetermined potential. Due to this, sufficient precharging of a signal line, which became difficult due to an increase of a load capacitance of the signal line due to higher definition of the image display device and an increase in the speed of a drive clock thereof, can be achieved.

8 Claims, 9 Drawing Sheets

U.S. PATENT DOCUMENTS

| | | | | |
|---|---|---|---|---|
| 5,892,493 | A * | 4/1999 | Enami et al. | 345/94 |
| 6,744,417 | B2 * | 6/2004 | Yamashita et al. | 345/92 |
| 6,873,313 | B2 * | 3/2005 | Washio et al. | 345/100 |
| 2003/0107561 | A1 | 6/2003 | Uchino et al. | |

FOREIGN PATENT DOCUMENTS

| | | | |
|---|---|---|---|
| EP | 1 347 436 | A | 9/2003 |
| JP | 07-295515 | A | 11/1995 |
| JP | 09-033891 | | 2/1997 |
| JP | 09-033894 | A | 2/1997 |
| JP | 10-011032 | A | 1/1998 |
| JP | 11-338438 | A | 12/1999 |
| JP | 2003-122322 | A | 4/2003 |
| JP | 2003-177720 | A | 6/2003 |

OTHER PUBLICATIONS

Supplemental European Search Report dated Dec. 12, 2008 for corresponding European Application No. 04 77 2264.

Japanese Office Action dated Jan. 29, 2008 for corresponding Japanese Application No. 2003-298661.

* cited by examiner

NMOS SWITCH

FIG. 7A
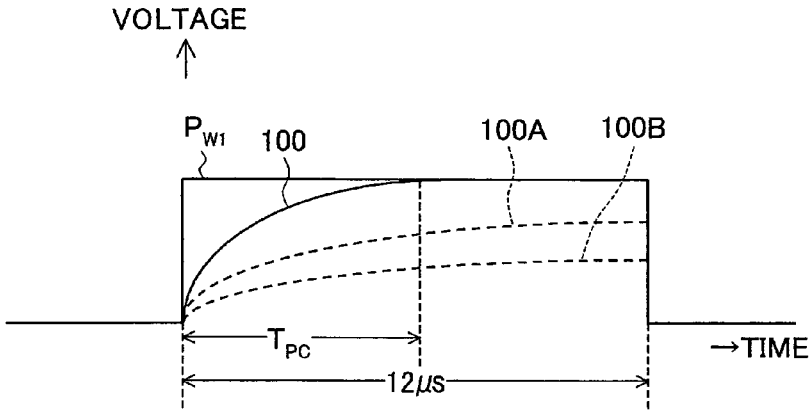
FIG. 7B
FIG. 7C
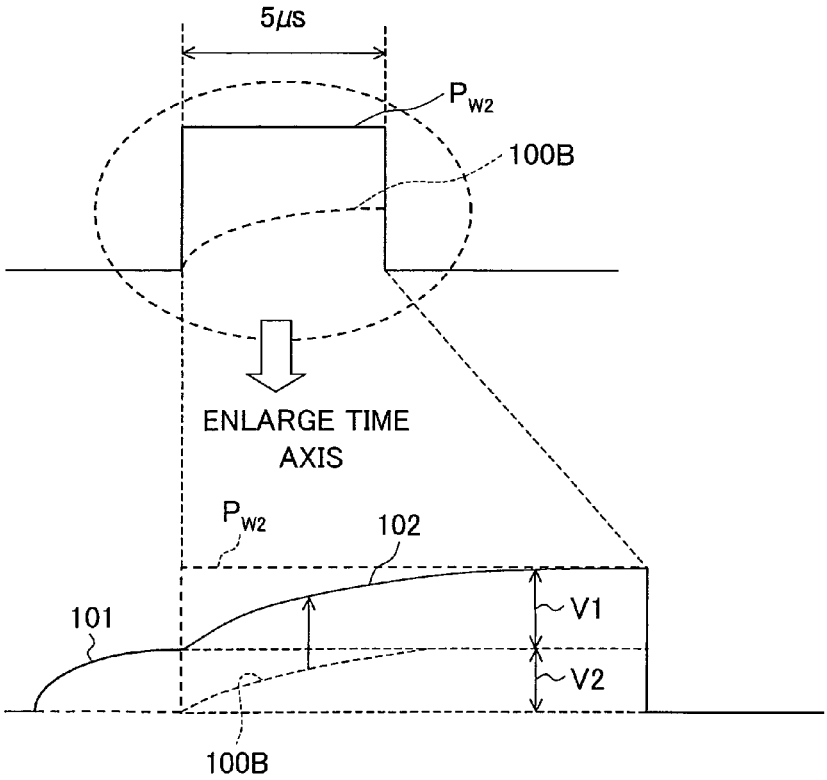

IMAGE DISPLAY DEVICE, IMAGE DISPLAY PANEL, PANEL DRIVE DEVICE, AND METHOD OF DRIVING IMAGE DISPLAY PANEL

TECHNICAL FIELD

The present invention relates to an image display device for precharging a signal line with a predetermined potential in advance when successively supplying pixel data of three primary colors to the related signal line during a period excluding a blanking period of one horizontal scanning period, that is, a line display period, an image display panel having a precharge function, and a drive device and a method of driving an image display device.

BACKGROUND ART

An image display device, for example, a liquid crystal display or other image device display having fixed pixels, as is well known, has an effective pixel area in which a plurality of pixel circuits (hereinafter simply referred to as "pixels") are arrayed in a matrix and in which three primary colors are assigned to the pixels in a predetermined array.

Each pixel of the liquid crystal display, while not particularly shown, is comprised of a pixel select element constituted by a thin film transistor (TFT), a liquid crystal cell having a pixel electrode connected to a drain electrode (or a source electrode) of the TFT, and a storage capacitor having one electrode connected to the drain electrode of the TFT.

These pixels have scanning lines laid along the pixel array direction of the pixel rows (hereinafter also referred to as "pixel lines") and signal lines referred to as data lines laid along the pixel array direction of the pixel columns. Gate electrodes of the TFTs of the pixels are connected to the same scanning line in units of pixel rows, while source electrodes (or drain electrodes) thereof are connected to the same signal line in units of pixel columns.

Such liquid crystal displays and other image display devices are becoming higher in definition year by year. The load capacitances of the scanning lines and the signal lines are increasing along with this.

Further, the video signal of the existing NTSC (National Television System Committee) system is set in its screen display period to a frequency of 60 Hz per field (about 16.7 ms in terms of time) and a frequency of 30 Hz per frame (about 33.3 ms in terms of time). Accordingly, when the number of pixel lines increases accompanying higher definition, the time assigned to the display of one pixel line becomes short. The display period of this one pixel line is a period excluding the horizontal blanking period of a head portion in one horizontal scanning (1H) period as referred to in the NTSC video signal format.

In a high definition image display device, when a group of pixels of the effective pixel area is successively and repeatedly displayed for each of the three primary colors, the short line display period and the increased load capacitance of the signal lines explained above result in insufficient writing of the pixel data within a predetermined time and the inability to express colors of a predetermined luminance.

Particularly, in a liquid crystal display, a liquid crystal layer sometimes deteriorates when an electric field having the same orientation is applied to the liquid crystal layer for a long time. From the viewpoint of preventing this, the method of driving by inverting the polarity of the pixel data for each pixel line is the general practice. For this reason, in a liquid crystal display, on average, it is necessary to change the signal line potential to about 2 times the pixel data. Since a long time is taken for changing this large potential difference, the insufficiency of the writing capacity of pixel data accompanying the higher definition has become remarkable.

FIG. 7A and FIG. 7B show waveforms of pulses for writing pixel data into signal lines. Here, FIG. 7A is a write pulse waveform diagram of a liquid crystal display having a low resolution, and FIG. 7B is a write pulse waveform diagram of a liquid crystal display having a high resolution.

When the resolution of the display is low, the time duration of the permission pulse Pw1 for the supply of data to the signal line is, for example, 12 μs which is relatively long. The pixel data is supplied to the signal line from a rising edge of this permission pulse Pw1. The potential 100 of the signal line starts to rise from that time and reaches a desired potential in accordance with a CR time constant determined according to the load capacitance of the signal line. A time Tpc required for charging this signal line is sufficiently small in comparison with the pulse time duration (12 μs).

When the resolution of the display becomes high, however, the load capacitance abruptly increases and the CR time constant of the interconnects becomes high as explained before. Therefore, the situation arises in which the waveform becomes dull in accordance with the load capacitance, like a signal line potential 100A or 100B shown in FIG. 7A, the signal line potential cannot reach the predetermined write potential within the predetermined write time, and the signal line cannot be sufficiently charged.

In addition, as shown in FIG. 7B, the write time per se becomes, for example 5, μs, which is short, and therefore, even if the load capacitance does not increase very much, sufficient charging of the signal line becomes difficult.

In order to eliminate the insufficiency in the writing operation, the technique of precharging the signal line for boosting the signal line potential to an intermediate potential preceding the writing of the pixel data is known (see, for example, Japanese Patent Publications: Japanese Patent Publication (A) No. H10-011032 or Japanese Patent Publication (A) No. 2003-177720).

When employing this technique of precharging a signal line, as shown in FIG. 7C, if a signal line potential 102 can reach a certain intermediate potential by the previously performed precharging (waveform 101) at the starting point of the rising edge of a permission pulse Pw2 of the supply of data to the signal line, it becomes possible to make the signal line potential 102 reach the desired potential within a short permission pulse time.

The precharge waveforms are drawn superposed at the time of charging of the signal line by the pixel data in FIG. 7C for convenience sake, but as disclosed in the above two publications, the signal line is frequently precharged in the horizontal blanking period located at the head portion of one horizontal scanning period (1H).

Incidentally, the shortening of the write time accompanying the higher definition of the display described above occurs because the drive clock frequency becomes high in addition to the increase of pixel number of one pixel line. Therefore, the horizontal blanking period also becomes short, and sometimes there is no longer a sufficient precharging time. Further, the amount to be precharged in the signal line increases, and therefore the precharging in such a horizontal blanking period has become difficult. Accordingly, realistically, there are actual circumstances where the effect of precharging as shown in FIG. 7C are not sufficiently obtained with a high definition display.

An explanation of this is given by a more detailed example using FIG. 8A, in a low resolution liquid crystal display device having, for example, 480×320 pixels or less; as shown in FIG. 8A, separately from the interior of a horizontal drive circuit 111 arranged at one end of an effective pixel region 110, a precharge circuit 112 is provided on an opposite side of the signal line 113. The horizontal drive circuit 111 is provided with a select switch for controlling an output of the pixel data constituted by a CMOS transfer gate TG1 for each signal line 113. In the same way, the precharge circuit 112 is provided with a CMOS transfer gate TG2. The supply of the precharge voltage is controlled by this CMOS transfer gate TG2.

FIG. 8B shows details of two CMOS transfer gates. At the time of the horizontal drive of the display, a precharge signal SPC is applied to the signal line 113 of the effective pixel area from the CMOS transfer gate TG2 in the precharge circuit 112, and then a pixel data signal SDT is input to the signal line 113 of the effective pixel area from the CMOS transfer gate TG1 of the horizontal drive circuit side.

In a high resolution liquid crystal display device having 640×480 pixels or more corresponding to the VGA, however, as previously explained, the drive frequency for driving the device becomes high and, at the same time, the load capacitance of the interconnects of the display device increases. Therefore, the signal line potential no longer reaches the expected intermediate potential in the predetermined write time, an insufficient write operation occurs, and as a result a clear image is no longer obtained.

In this case, in order to perform a stable precharge, the size of the CMOS transfer gate TG2 must be increased, so the area occupied by the precharge circuit 112 increases. In addition, the impedance of the signal line 113 must be lowered, the width of the interconnects must be broadened, and so on. Due to these problems, the percentage of substrate area occupied by the interconnects for precharging increases in the same way as above. Further, in package precharging, a high precharging capability is required; therefore, as shown in the overall block diagram in FIG. 9, the horizontal drive circuit (HDRV) 111 and the precharge circuit (PCH) 112 must be separately provided or one of two horizontal drive circuits must be equipped with the precharge function, so the increase of the area penalty of the precharge circuit becomes a problem.

Further, the lowest limit of the precharging sometimes differs for each of the three primary colors. In such a case, with package precharging in the horizontal blanking period, the problem of wasteful precharging for some of the colors arises.

DISCLOSURE OF THE INVENTION

The first problem to be solved by the present invention is that sufficient precharging of a signal line becomes difficult due to the higher definition of the image display device and the consequent higher speed of the drive clock, the shortening of the time of supply of the pixel data to the signal line, the increase in the signal line load capacitance, and other factors.

Further, the second problem to be solved by the present invention is that a high precharging capability is required for package precharging for each of the three primary colors or each line, the scale of the precharge circuit increases and the area penalty becomes large, and wasteful power consumption occurs.

The image display device (1) according to the present invention has a group of pixels (effective pixel area 2) arranged in a matrix in a predetermined array and assigned to three primary colors, and has a signal line (6-1, 6-2, . . . , 6-*n*) connected for each column of the group of pixels, wherein pixel data of three primary colors (61R, 61G, 61B) are successively supplied for each color to a corresponding signal line (6-1, 6-2, . . . , 6-*n*) during a period excluding a blanking period (1HB) of one horizontal scanning period (1H) constituted by a line display period (time duration of a pulse 60) for the color display of one pixel line, and wherein a select switch (TMG) is connected to each of the signal lines (6-1, 6-2, . . . , 6-*n*), a precharging control circuit (40) is connected to the select switch (TMG), and the precharging control circuit (40) supplies permission pulses (63R, 63G, 63B) for the supply of data to signal lines (6-1, 6-2, . . . , 6-*n*) when making them display one color among three primary colors in the line display period (time duration of pulse 60) to the select switch (TMG) of the corresponding signal line (6-1, 6-2, . . . , 6-*n*) to turn the same on, turns on the select switch (TMG) of the signal line (6-1, 6-2, . . . , 6-*n*) corresponding to another color to be displayed later in the same line display period (time duration of the pulse 60) during a period of supply (time duration of pulses 63R, 63G, 63B) of permission pulses of the supply of data with a precharge pulse (62R, 62G, 62B) having a time duration shorter than the supply time of the pixel data of the other color, and precharges the signal line (6-1, 6-2, . . . , 6-*n*) of the other color in advance to a predetermined potential.

Preferably, the precharging control circuit (40) changes the time duration or number of the precharge pulses (62R, 62G, 62B) to increase the time of the precharge the shorter the time duration of the permission pulse (63R, 63G, 63B) for the supply of data and the later the display of the color in the line display period (time duration of the pulse 60).

More preferably, the precharging control circuit (40) supplies the precharge pulse (62R, 62G, 62B) for the precharge in the blanking period (1HB) located in the head portion of one horizontal scanning period (1H) to the signal line (6-1, 6-2, . . . , 6-*n*) corresponding to the color to be displayed first during the line display period (time duration of pulse 60).

An image display panel according to the present invention has a group of pixels (effective pixel area 2) arranged in a matrix in a predetermined array and assigned to three primary colors, and has a signal line (6-1, 6-2, . . . , 6-*n*) connected for each column of the group of pixels, wherein pixel data of three primary colors (61R, 61G, 61B) are successively supplied for each color to a corresponding signal line (6-1, 6-2, . . . , 6-*n*) during a period excluding a blanking period (1HB) of one horizontal scanning period (1H) constituted by a line display period (time duration of a pulse 60) for the color display of one pixel line, and wherein the image display panel is provided with a precharging control circuit (40), and the precharging control circuit (40) is connected to a select switch (TMG) connected to each of the signal lines (6-1, 6-2, . . . , 6-*n*), supplies permission pulses (63R, 63G, 63B) for the supply of data to signal lines (6-1, 6-2, . . . , 6-*n*) when making them display one color among three primary colors in the line display period (time duration of pulse 60) to the select switch (TMG) of the corresponding signal line (6-1, 6-2, . . . , 6-*n*) to turn the same on, turns on the select switch (TMG) of the signal line (6-1, 6-2, . . . , 6-*n*) corresponding to another color to be displayed later in the same line display period (time duration of the pulse 60) during a period of supply (time duration of pulses 63R, 63G, 63B) of permission pulses of the supply of data with a precharge pulse (62R, 62G, 62B) having a time duration shorter than the supply time of the pixel data of the other color, and precharges the signal line (6-1, 6-2, . . . , 6-*n*) of the other color in advance to a predetermined potential.

A panel drive device according to the present invention is provided for successively supplying pixel data of three primary colors (61R, 61G, 61B) for each color to a corresponding signal line (6-1, 6-2, . . . , **6-*n*) of an image display panel having a group of pixels (effective pixel area 2) arranged in a matrix in a predetermined array and assigned to three primary colors and having the signal line (6-1, 6-2, . . . , 6-*n*) connected for each column of the group of pixels during a period excluding a blanking period (1HB) of one horizontal scanning period (1H) constituted by a line display period (time duration of a pulse 60) at the time of driving each pixel line, the panel drive device having a built-in precharging control circuit (40), and wherein the precharging control circuit (40) is connected to a select switch (TMG) connected to each of the signal lines (6-1, 6-2, . . . , 6-*n*), supplies permission pulses (63R, 63G, 63B) for the supply of data to signal lines (6-1, 6-2, . . . , 6-*n*) when displaying one color among three primary colors in the line display period (time duration of pulse 60) to the select switch (TMG) of the corresponding signal line (6-1, 6-2, . . . , 6-*n*) to turn the same on, turns on the select switch (TMG) of the signal line (6-1, 6-2, . . . , 6-*n*) corresponding to another color to be displayed later in the same line display period (time duration of the pulse 60) during a period of supply (time duration of pulses 63R, 63G, 63B) of permission pulses of the supply of data with a precharge pulse (62R, 62G, 62B) having a time duration shorter than the supply time of the pixel data of the other color, and precharges the signal line (6-1, 6-2, . . . , 6-*n***) of the other color in advance to a predetermined potential.

A method is provided for driving an image display panel according to the present invention for successively supplying pixel data of three primary colors (61R, 61G, 61B) for each color to a corresponding signal line (6-1, 6-2, . . . , **6-*n*) of an image display panel having a group of pixels (effective pixel area 2) arranged in a matrix in a predetermined array and assigned to three primary colors and having the signal line (6-1, 6-2, . . . , 6-*n*) connected for each column of the group of pixels during a period excluding a blanking period (1HB) of one horizontal scanning period (1H) constituted by a line display period (time duration of a pulse 60) for a color display for each pixel line, comprising supplying permission pulses (63R, 63G, 63B) for the supply of data to signal lines (6-1, 6-2, . . . , 6-*n*) when making them display one color among three primary colors in the line display period (time duration of pulse 60) to the select switch (TMG) of the corresponding signal line (6-1, 6-2, . . . , 6-*n*) to turn the same on and turning on the select switch (TMG) of the signal line (6-1, 6-2, . . . , 6-*n*) corresponding to another color to be displayed later in the same line display period (time duration of the pulse 60) during a period of supply (time duration of pulses 63R, 63G, 63B) of permission pulses of the supply of data with a precharge pulse (62R, 62G, 62B) having a time duration shorter than the supply time of the pixel data of the other color so as to precharge the signal line (6-1, 6-2, . . . , 6-*n***) of the other color in advance to a predetermined potential.

The operation in the present invention will be explained by taking as an example an image display device (1) displaying colors in a sequence of RGB.

When a certain line is selected and the blanking period (1HB) of one horizontal scanning period (1H) ends and the line display period (time duration of pulse 60) is entered, a permission pulse (63B) for permitting the supply of data to the signal line (6-1, 6-2, . . . , **6-*n*) to which a pixel of one color among the three primary colors, for example, "blue (B)", is supplied from the precharging control circuit (40) to the select switch (TMG) connected to the signal line (6-1, 6-2, . . . , 6-*n*). Due to this, the pixel data of "B" is supplied to the signal line (6-1, 6-2, . . . , 6-*n*) with a ratio of, for example, one data per three lines for the color display. In the middle of application of the permission pulse (63B) for the supply of this B data and at a timing before the supply of the next "green (G)" data, the signal line (6-1, 6-2, . . . , 6-*n*) to be supplied with the G data is precharged. That is, the precharge pulse (62G) is applied to the select switch (TMG) of the signal line (6-1, 6-2, . . . , 6-*n*) to which the G pixel is connected. The time duration of this precharge pulse (62G) is shorter than that of the G pixel data pulse (61G), and therefore the intermediate potential is determined for the signal line (6-1, 6-2, . . . , 6-*n*) by this precharging. Thereafter, the permission pulse (63G) of the supply of the G data is applied, and the pixel data of "G" is supplied to the signal line (6-1, 6-2, . . . , 6-*n***) with the ratio of one data per three lines for the color display.

Below, in the same way, "red (R)" is precharged in the permission period of the supply of the G data. Note that "R" also may be precharged in the permission period of the supply of the first B data. In this case, the precharging time becomes longer or the precharge amount becomes larger the later the color is displayed.

Such line display is repeated, and then the video display of one screen ends.

BRIEF DESCRIPTION OF THE DRAWINGS

FIG. 4A is a circuit symbol diagram of one select switch, while

FIG. 7A to FIG. 7C are diagrams for explaining problems of the background art and showing relationships between permission pulses for supplying voltage to a signal line and a change in signal line potential used in the explanation of effects of the present invention.

BEST MODE FOR WORKING THE INVENTION

The present invention can be utilized preferably in an image display device of a beam scanning type like a CRT other than the image display device of fixed pixels, for example, a LCD (Liquid Crystal Display), a DMD (Digital Micro-mirror Device) or an organic EL element. Further, the present invention can be utilized preferably also for an image display device having a built-in precharge circuit or a drive device of the image display panel. Further, the present invention can be applied to both a line sequential driveline sequential drive and a point sequential drive.

Here, an embodiment of the present invention will be explained by taking as an example a liquid crystal display device of a so-called multiplex system (also referred to as a "selector system"), one type of line sequential drive, and decreasing the number of interconnects which are horizontally driven at one time by multiplex control. Here, the term "line sequence" means a "horizontal driving system for displaying color once at a time for each color of RGB in a display period of one pixel line", while the term "point sequence" means a "horizontal driving method for successive color display of RGB and repeated color display for each pixel in the display period of one pixel line".

Figure 1:
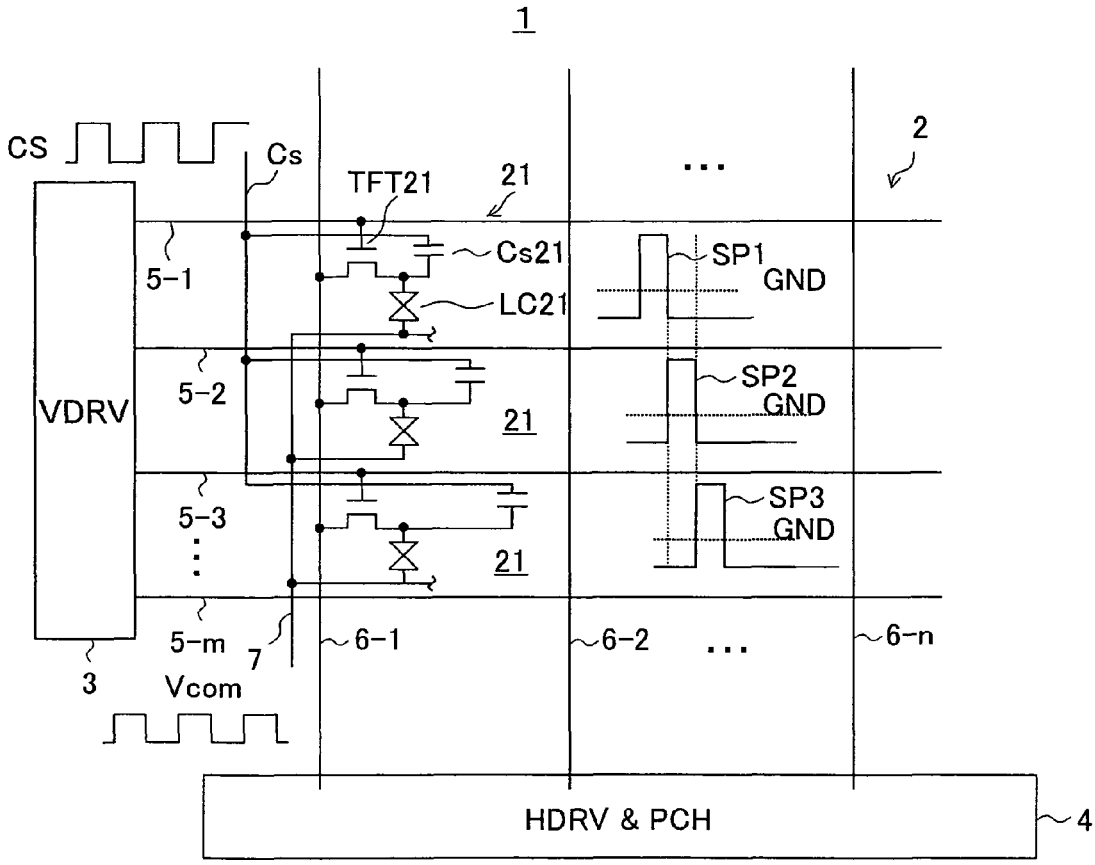
FIG. 1 is a block diagram of an example of the configuration of a liquid crystal display device according to an embodiment of the present invention.

FIG. 1 is a block diagram showing an example of the configuration of the liquid crystal display device according to the present embodiment.

The liquid crystal display device 1, as shown in FIG. 1, has an effective pixel area 2, a vertical drive circuit (VDRV) 3, and a horizontal drive circuit having a built-in precharge circuit (HDRV & PCH). The configuration of the precharge circuit (PCH) in this horizontal drive circuit 4 is one of the major characterizing features of the present embodiment.

In the effective pixel area 2, a plurality of pixels (hereinafter, referred to as "pixel circuits") 21 are arrayed in a matrix. Each pixel circuit 21 is configured by a pixel select element constituted by a thin film transistor (TFT) TFT 21, a liquid crystal cell LC21 with a pixel electrode connected to the drain electrode (or source electrode) of the thin film transistor TFT 21, and a storage capacitor Cs21 with one electrode connected to the drain electrode of the thin film transistor TFT 21.

For these pixel circuits 21, scanning lines 5-1 to **5-*m* are laid for each row along the pixel array direction, while signal lines 6-1 to 6-*n*** are laid for each column along the pixel array direction.

The gate electrode of the thin film transistor TFT 21 of each pixel circuit 21 is connected to one of the scanning lines 5-1 to **5-*m* determined in unit of rows. Further, the source electrode (or drain electrode) of the thin film transistor TFT 21 of each pixel circuit 21 is connected to one of the signal lines 6-1 to 6-*n*** determined in unit of columns.

Further, in the same way as a general liquid crystal display device, a storage capacitor interconnect Cs is independently laid, and a storage capacitor Cs21 is formed between this storage capacitor interconnect Cs and each pixel electrode. The storage capacitor interconnect Cs receives as input a horizontal direction drive pulse CS having the same phase as that of a common voltage Vcom.

The other electrode (common electrode) of the liquid crystal cell LC21 of each pixel circuit 21 is connected to a supply line 7 of the common voltage Vcom having a polarity inverting for each horizontal scanning period (1H).

The scanning lines 5-1 to **5-*m* are driven by the vertical drive circuit 3, while the signal lines 6-1 to 6-*n* are driven by the horizontal drive circuit 4**.

The vertical drive circuit 3 performs processing for scanning the scanning lines 5-1 to **5-*m* in the vertical direction (column direction) for each field period and successively selecting pixel circuits 21 connected to the scanning lines 5-1 to 5-*m*** in unit of rows.

Namely, pixels of columns of the first row are selected when a scanning pulse SP1 is given to the scanning line 5-1 from the vertical drive circuit 3, and pixels of columns of the second row are selected when a scanning pulse SP2 is given to the scanning line 5-2. Below, in the same way, scanning pulses SP3 (, . . . , SPm) are successively given to the scanning lines 5-3, . . . , **5-*m***.

The horizontal drive circuit 4 is a circuit for shifting the level of the pulse of the select signal supplied by a not shown clock generator and writes input video signals into pixel circuits in a line sequence by this operation. Further, the built-in precharge circuit thereof is a circuit for precharging signal lines 6-1 to **6-*n*** in advance to the predetermined potential for the color display of RGB at the time of line sequential drive.

Figure 2:
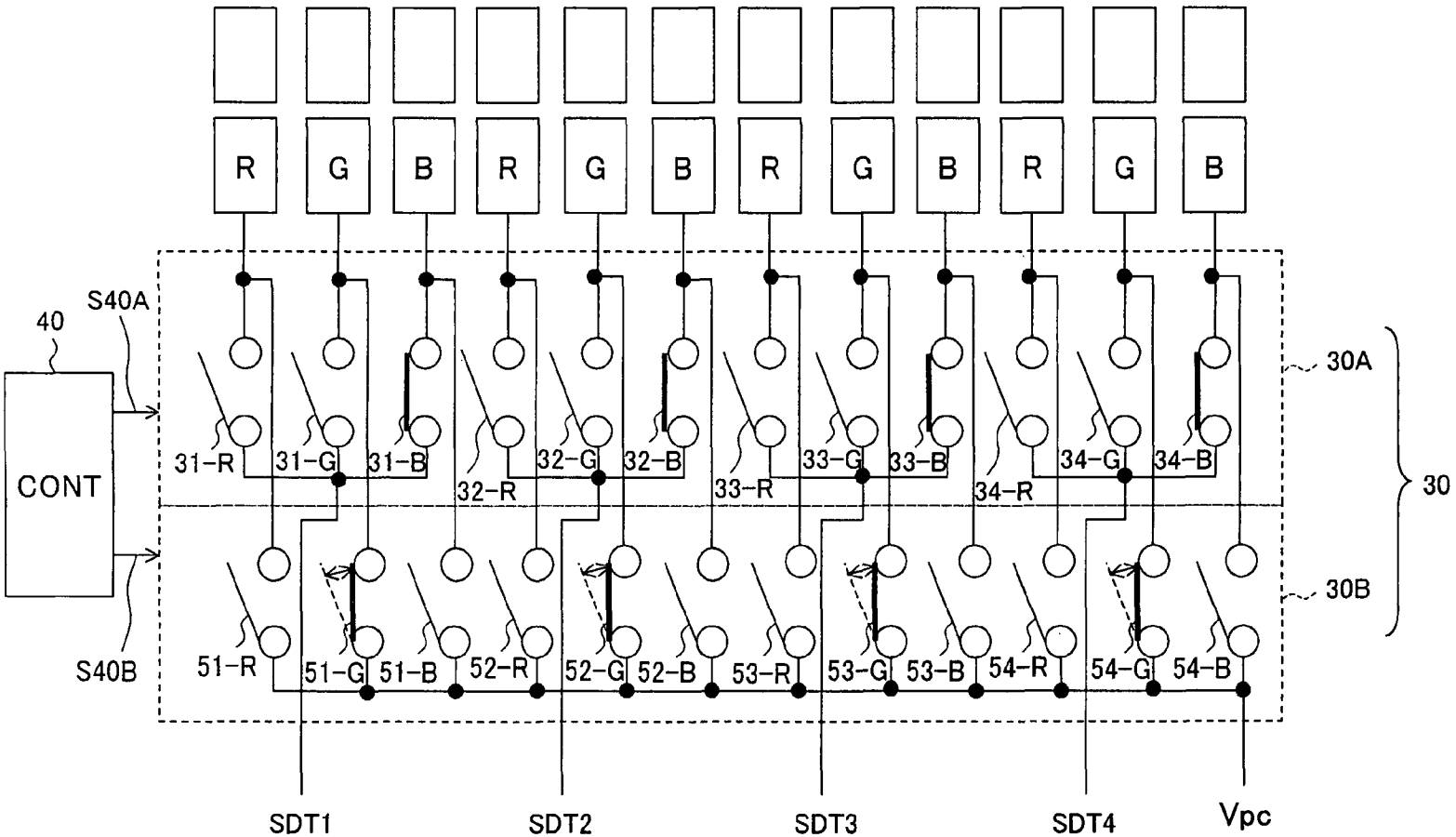
FIG. 2 is a circuit diagram of a selector of a horizontal drive circuit equipped with a precharge function.

FIG. 2 is a circuit diagram of a multiplexer configuration selector of the horizontal drive circuit 4 equipped with this precharge function. This selector is a circuit for controlling the permission for supply of the pixel data or the precharge voltage to each signal line based on a control signal from a control circuit.

A selector 30 shown in FIG. 2 may be roughly divided into a first select switch circuit unit 30A for controlling the permission for supply of pixel data and a second select switch circuit unit 30B for controlling the permission for supply of a precharge voltage Vpc.

The first select switch circuit unit 30A has select switches 31-R, 31-G, 31-B, . . . , 34-R, 34-G, 34-B (, . . . , **3*n*-R, 3*n*-G, 3*n*-B). The first select switch circuit unit 30A is for turning on or off the select switches according to a control signal S40A input from the control circuit 40 so as to select data signals SDT1 to SDT4 (, . . . ,) to be written into pixel circuits 21 and supplying the same to the signal lines 6-1 to 6-*n*** to thereby display a video image.

In this liquid crystal display device, the three primary color data, that is, the R (red) data, the G (green) data, and the B (blue) data, are successively supplied to the signal lines. Specifically, first the B data is supplied to the signal lines to which the B pixels of the selected pixel line are connected with a ratio of one data per three lines among the signal lines 6-1 to **6-*n*, next the G data is supplied to the signal lines to which the G pixels of the selected pixel line are connected in the same way, and finally the R data is supplied to the signal lines to which the R pixels of the selected pixel line are connected in the same way to thereby write the RGB data into the pixel circuits 21 and make them display the video image. Note that, here, one color is displayed at one pixel, but RGB may be used to define one pixel as well. In this case, the signal lines 6-1 to 6-*n*** each have three select switches connected to them.

FIG. 2 shows a state where only the select switches 31-B to 34-B corresponding to B are turned on. When the writing of the B data ends, only the select switches 31-G to 34-G corresponding to G are turned on to write the G data. When the writing of the G data ends, only the select switches 31-R to 34-R corresponding to R are turned to write the R data. Note that any arrangement of RGB and sequence of the data write operations may be used.

On the other hand, the second select switch circuit unit 30B for precharging has the same number of select switches 51-R, 51-G, 51-B, . . . , 54-R, 54-G, 54-B (, . . . , **5*n*-R, 5*n*-G, 5*n*-B) as the first select switch circuit unit 30A. These select switches are connected to signal lines parallel to single select switches of the first select switch circuit unit 30A. That is, in the first three columns, select switches 31-R and 51-R, 31-G and 51-G, and 31-B and 51-B are connected to signal lines as pairs. Also, in the other columns, the same connection configuration is repeated. Terminals on the opposite sides to the signal lines of the select switches 51-R to 54**-B are commonly connected to the supply line of the precharge voltage Vpc.

The second select switch circuit unit 30B turns on or off each select switch according to a control signal S40B input from the control circuit 40, selects the signal lines 6-1 to **6-*n*** to which the precharge voltage Vpc should be supplied, and controls the amount of precharge (precharging time where the precharge voltage Vpc is constant).

Figure 3:
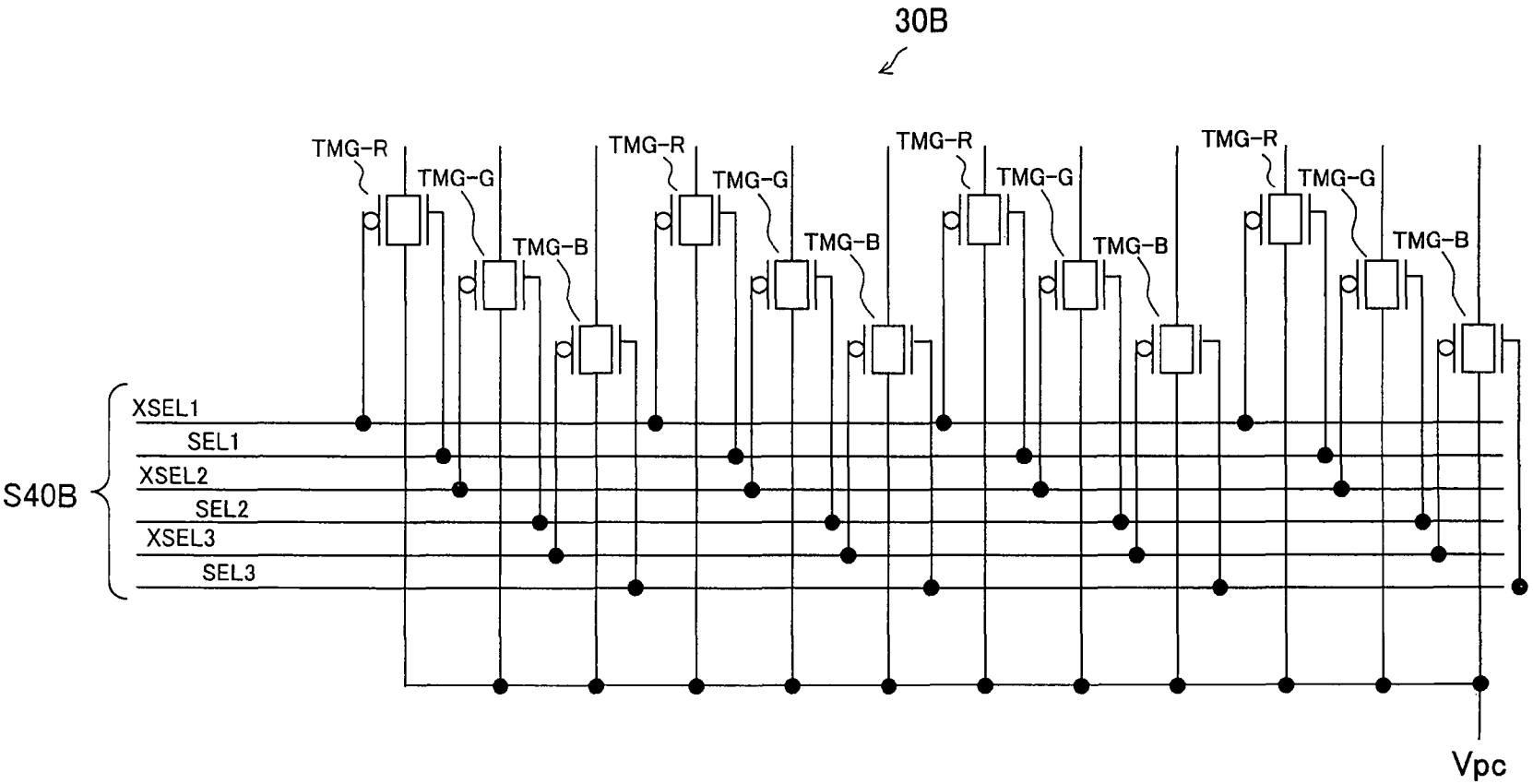
FIG. 3 is a more specific circuit diagram of a second select switch circuit unit for precharging.
Figure 4A:
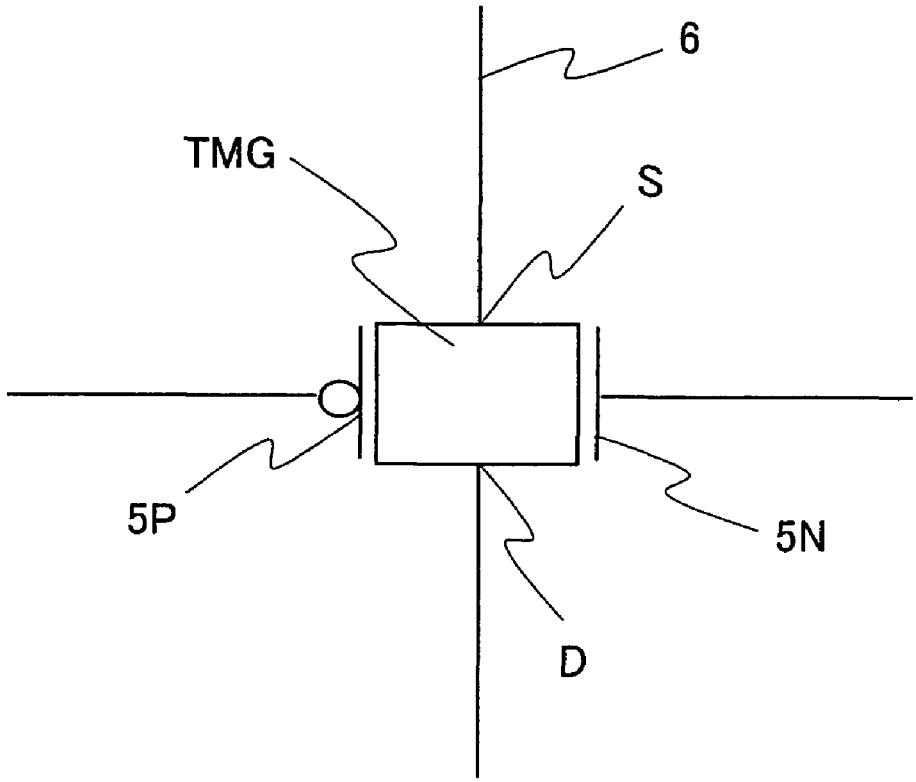

FIG. 3 shows an example of a more specific circuit taking as an example the second select switch circuit unit 30B for precharging. Further, an enlarged view of one select switch is shown in FIG. 4A. Note that, the difference of the configuration of the first select switch circuit unit 30A for supply of the pixel data from FIG. 3 resides in that not all of the first terminals of the select switches are common. By being made common for each RGB and connected to the supply lines of the pixel data signals SDT1 to SDT4 (see FIG. 2), the switch configuration per se is the same, so an explanation is omitted here.

Each of the select switches 51-R, 51-G, 51-B, . . . , 54-R, 54-G, 54-B (, . . . , 5*n*-R, 5*n*-G, 5*n*-B) shown in FIG. 2 is configured by, as shown in FIG. 4A, a transfer gate TMG-R, TMG-G, or TMG-B (described as TMG all together in FIG. 4A) formed by connecting sources ("S") of a p-channel MOS (PMOS) transistor 5P and an n-channel MOS (NMOS) transistor 5N to each other and connecting drains ("D") thereof to each other.

Figure 4B:
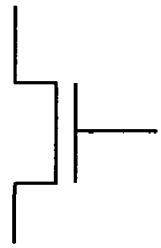
FIG. 4B is a circuit symbol diagram showing a modification of the select switch.

Note that, where a COMS configuration is not employed, it is also possible to configure the select switch by one NMOS transistor as shown in FIG. 4B.

In each transfer gate, as shown in FIG. 3, the conduction is controlled according to select signals SEL1, XSEL1, SEL2, XSEL2, SEL3, and XSEL3 taking complementary levels. The set of these select signals becomes the control signal S40B.

Specifically, the transfer gates TMG-R configuring the R data use select switches 51-R to 54-R are controlled in conduction by the select signals SEL1 and XSEL1. The transfer gates TMG-G configuring the G data use select switches 51-G to 54-G are controlled in conduction by the select signals SEL2 and XSEL2. The transfer gates TMG-B configuring the B data use select switches 51-B to 54-B are controlled in conduction by the select signals SEL3 and XSEL3.

By employing such a configuration, the select switches used when supplying the pixel data to the signal lines in the multiplex system and the select switches for precharging can be provided close, and therefore there is the advantage that the switching characteristics of transistors become uniform within the drive device of the image display panel (for example drive IC), so the timing can be correctly controlled.

Next, the precharge operation will be explained with reference to the timing charts shown in FIG. 5A to FIG. 5G.

Figures 5A, 5B, 5C, 5D, 5E, 5F, 5G:
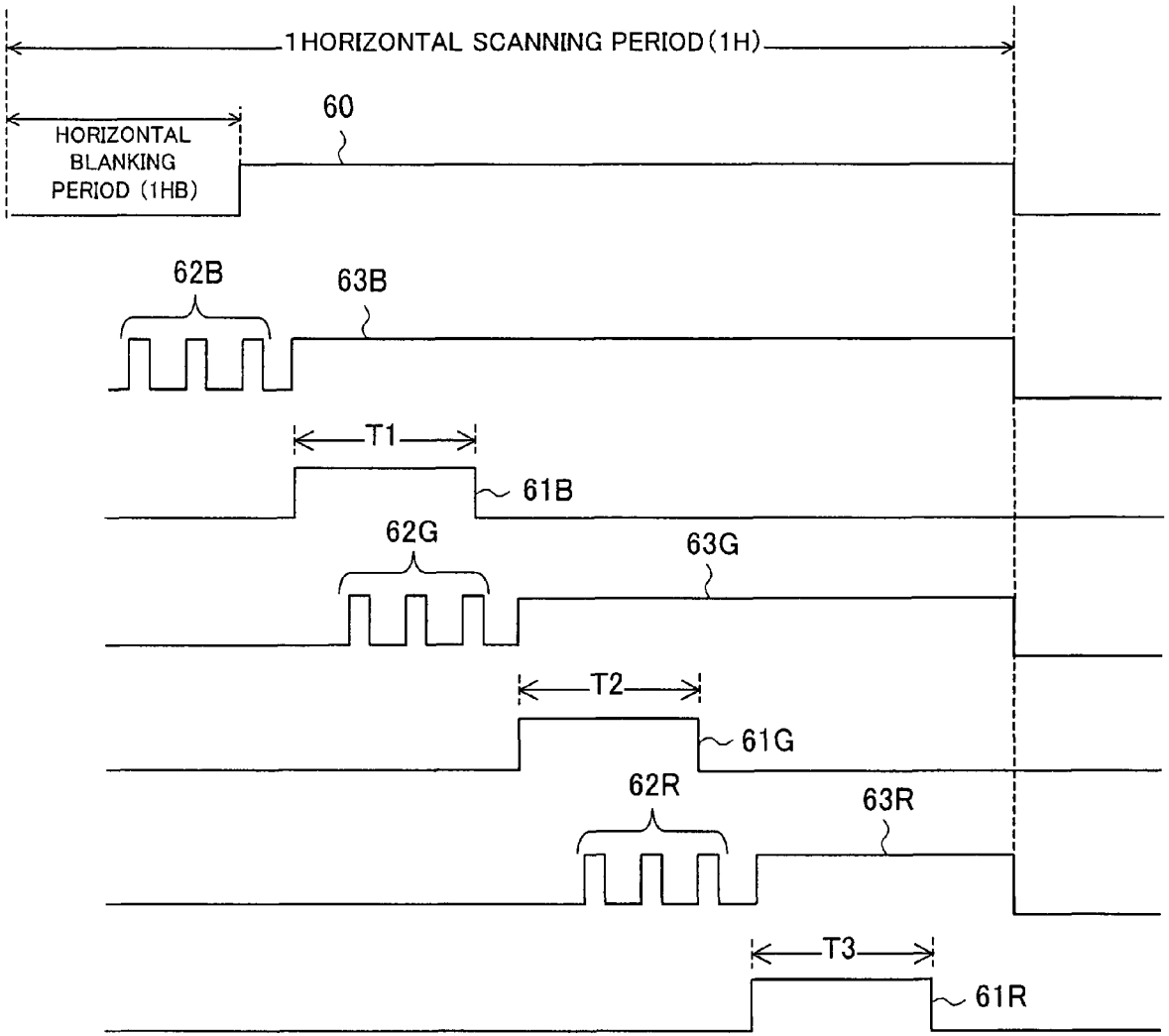
FIG. 5A to FIG. 5G are timing charts of pulses at the time of a precharge operation.
Figures 6A, 6B, 6C, 6D:
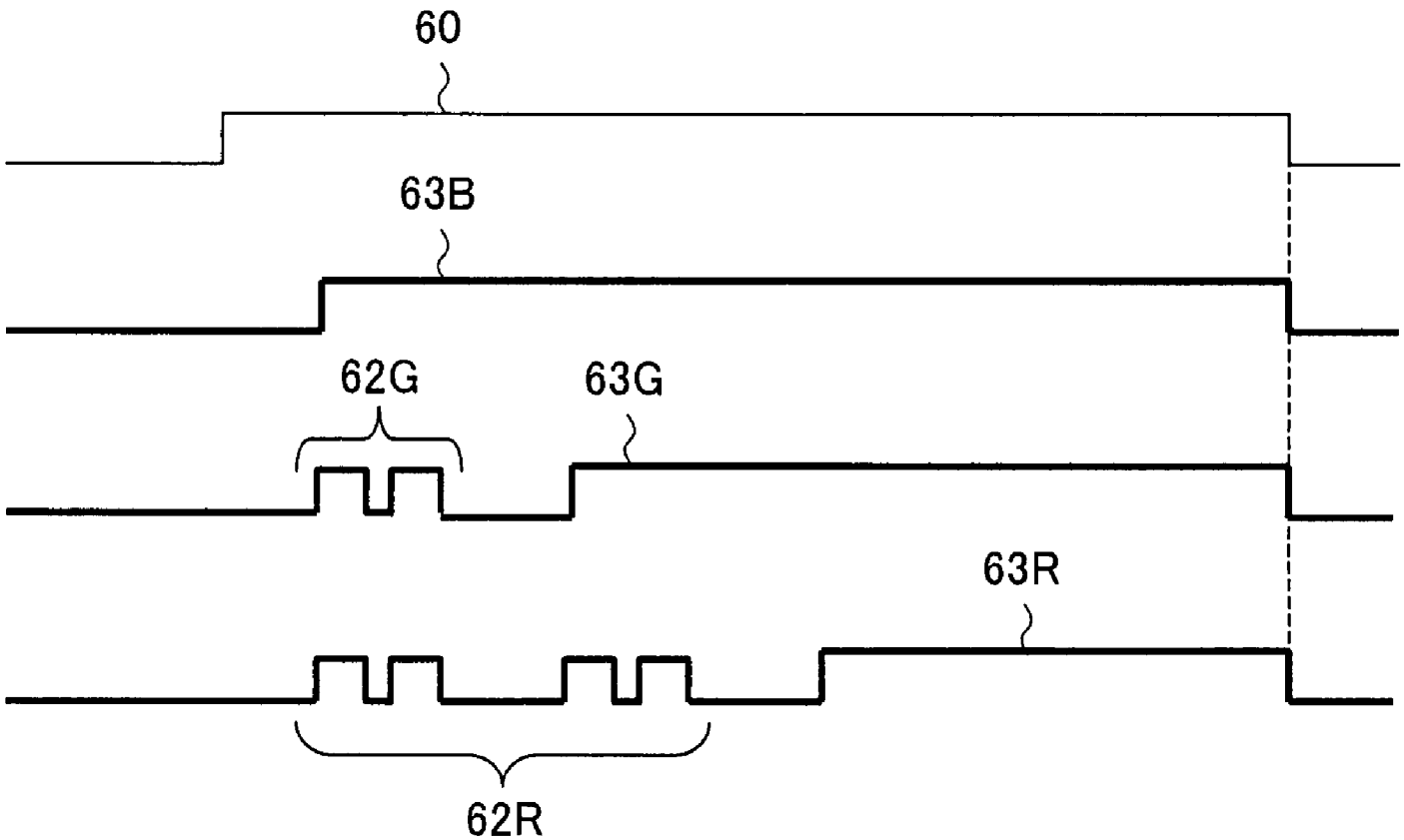
FIG. 6A to FIG. 6D are timing charts showing another example of precharge pulses.
Figure 8A:
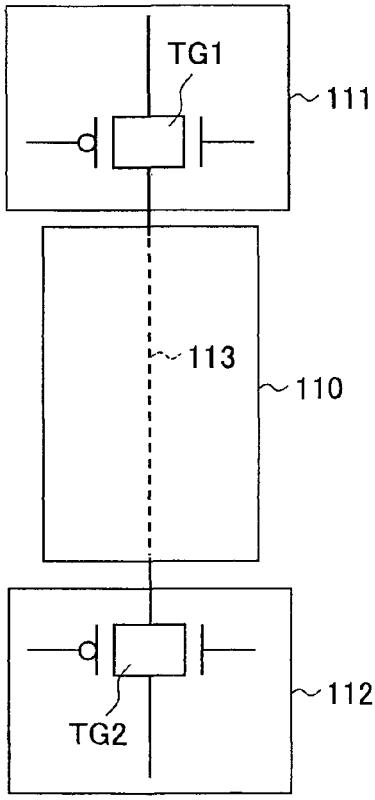
FIG. 8A and FIG. 8B are explanatory diagrams of pixel data and a technique of precharging from a different side of the signal line used in the explanation of the background art.
Figure 8B:
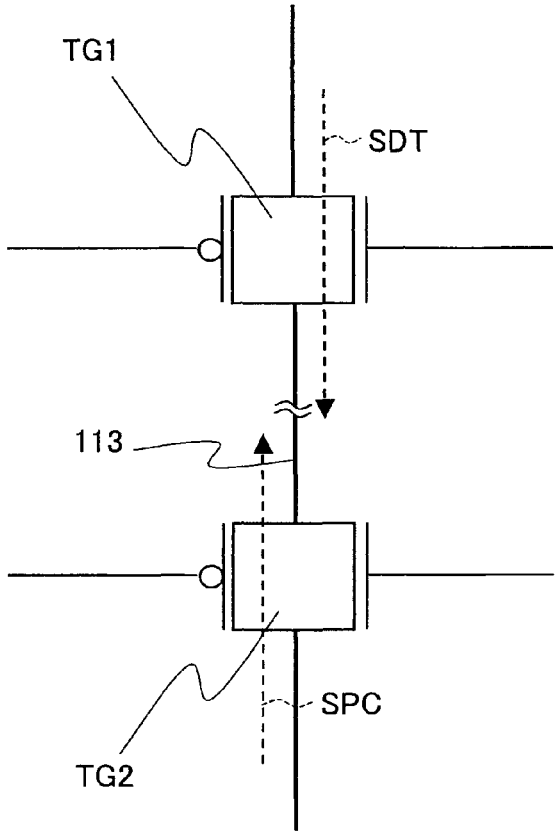
Figure 9:
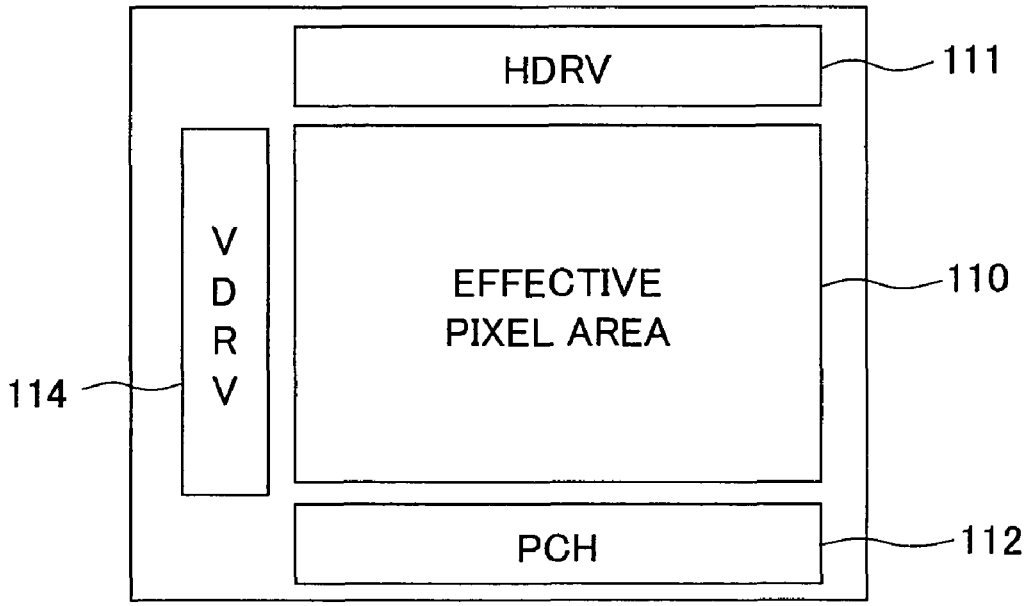
FIG. 9 is a block diagram of an image display device separately arranging a horizontal drive circuit and a precharge circuit disclosed in the prior art.

As a horizontal pulse 60 shown in FIG. 5A, use can be made of, for example, a horizontal direction drive pulse CS shown in FIG. 1 or a pulse for inverting the video data and the precharge voltage for each pixel line. A predetermined time before this horizontal pulse 60 corresponds to the horizontal blanking period (1HB) in the horizontal scanning period (1H), and the time duration of this horizontal pulse 60 corresponds to the line display period.

FIG. 5C, FIG. 5E, and FIG. 5G show an image data pulse 61B (pulse time duration: T1) of the B (blue) signal, an image data pulse 61G (pulse time duration: T2) of the G (green) signal, and an image data pulse 61R (pulse time duration: T3) of the R (red) signal. In a display of a line sequence, the color display of RGB signals is carried out in just one cycle for one pixel line in the predetermined sequence in this way.

Precharge pulses with respect to the colors B, G, and R are indicated by any number of pulses 62B, 62G or 62R of the short time shown before the image data pulses of the different colors. Three pulses of each color are shown here, but there may be any number, and the number may be different for each color. The number of precharge pulses 62B with respect to the B signal is 0, that is, this can be omitted too. The precharge pulse 62B to the B signal must be applied before the application of the image data pulse 61B. In the same way, the precharge pulse 62G must be applied to the G signal before the application of the image data pulse 61G, and the precharge pulse 62R must be applied to the R signal before the application of the image data pulse 61R.

Usually, the image data pulses 61G and 61R are applied without a long time from the application of the image data pulse of the color immediately before that; therefore, the image data pulse 61B and the precharge pulse 62G overlap in time, and the image data pulse 61G and the precharge pulse 62R overlap in time. On the other hand, when the precharge pulse 62B of the first B signal exists, this pulse 62B may overlap the horizontal blanking period 1HB in time.

Here, the pulses 63B, 63G, and 63R shown in FIG. 5B, FIG. 5D, and FIG. 5F are permission pulses of the supply of image data for turning on select switches. The pulse time duration thereof is different for each color. That is, the permission pulse of the supply of the pixel data of the color to be displayed earlier has longer time duration. As a problem of the high definition display explained above, the increase of the interconnect capacitance and the slow charging of the signal line potential were explained (see FIG. 7A), but in such a case, the signal line is charged to a higher potential the longer the selector switch is open. That is, the precharging becomes more sufficient the longer the time duration of the permission pulse for supply of the pixel data. In that sense, sometimes, the precharge pulse 62B of the header B signal is unnecessary. Even in the case where it is necessary, the time (or amount) of the precharging can be made short. Further, the time (or amount) of the precharging by the precharge pulse 62G of the next G signal can be made shorter (smaller) than the time (or amount) of the precharging by the precharge pulse 62R of the next R signal. In the case of a high definition display, in this way, the supply of the pixel data becomes more insufficient the later the color is displayed, and therefore, desirably, the precharge is applied more strongly for a color displayed later.

FIG. 6A to FIG. 6D show an example where the precharge is applied more strongly for a color displayed later in this way. Note that the degree of precharge (amount) can be controlled by changing the number of pulses shown in FIG. 6. In addition, it can be controlled by the pulse time duration, or can be controlled by the value of the precharge voltage Vpc supplied at the time of the pulse ON, and can be controlled further by a combination of them. Note that when the precharge voltage Vpc is substantially equal to the average pixel data voltage value, the time duration of the precharge pulse is desirably made shorter than the time duration of the pixel data pulse.

By such control, as shown in FIG. 7C, even when the rise V1 of the potential due to the pixel data of each signal line is low, an offset voltage value V2 due to the precharging before that can be set reliably or with only the required value in accordance with the color. As a result, a video display of a desired brightness and a desired color balance can be achieved, and a high quality image is obtained.

Further, as shown in FIG. 1, one horizontal drive circuit 4 also can be used as a precharge circuit, the area can be reduced, and the production cost can be kept down.

Note that, in the above explanation, the case where the present invention was applied to an image display device was explained, but the present invention also can be applied to a display panel and drive device in a case where a precharge circuit having the configuration as shown in FIG. 2 is configured by TFTs, etc. and built in the display panel or a case where a precharge circuit having the configuration as shown in FIG. 2 is built in the device for driving the display panel (for example, the drive IC).

In this way, in the image display device, the image display panel, the panel drive device, and the method of driving the image display panel of the present invention, even when liquid crystal display devices become higher in resolution and higher in definition, there is the advantage of resistance to malfunctions and deterioration of the image quality at the color display. Further, because the pulse drive has a short time duration, in comparison with package precharging, there is little wasted power consumption. Particularly, the required precharge amount can be set for each color, and therefore there is no waste electrically in this point as well. Accordingly, the area and size of the precharging control circuit can be lowered to the lowest required limit.

LIST OF REFERENCES

1: liquid crystal display device
2: effective pixel area
3: vertical drive circuit (VDRV)
4: horizontal drive circuit equipped with precharge function (HDRV&PCH)
5P: pMOS transistors
5N: NMOS transistors
5-1 to **5-*m***: scanning lines
6, 6-1 to **6-*n***: signal lines
7: Vcom supply line
21: pixel circuit (pixel)
30: selector
30A: first select switch circuit
30B: second select switch circuit
31-R etc., 51-R etc. (and TMG): select switch (transfer gate)
40: control circuit
60: horizontal pulse
61B etc.: pixel data pulse
62B etc.: precharge pulse
63B etc.: permission pulse for supply of pixel data
Cs: storage capacitor interconnect
TFT21: pixel select element
LC21: liquid crystal cell, Cs21: storage capacitor

The invention claimed is:

1. An image display device having a group of pixels arranged in a matrix in a predetermined array and assigned to three primary colors, and having a signal line connected for each column of the group of pixels, wherein pixel data of three primary colors are successively supplied for each color to a corresponding signal line during a period excluding a blanking period of one horizontal scanning period constituted by a line display period for the color display of one pixel line, and wherein a select switch is connected to each of the signal lines, and a precharging control circuit is connected to the select switch, the precharging control circuit supplies permission pulses for the supply of data to signal lines when making them display one color among three primary colors in the line display period to the select switch of the corresponding signal line to turn the same on, turns on the select switch of the signal line corresponding to another color to be displayed later in the same line display period during a period of supply of permission pulses of the supply of data with a precharge pulse having a time duration shorter than the supply time of the pixel data of the other color, and precharges the signal line of the other color in advance to a predetermined potential.

2. The image display device as set forth in claim 1, wherein the precharging control circuit changes the time duration or number of the precharge pulses to increase the time of the precharge the shorter the time duration of the permission pulse for the supply of data and the later the display of the color in the line display period.

3. The image display device as set forth in claim 1, wherein the precharging control circuit supplies the precharge pulse for the precharge in the blanking period located in the head portion of one horizontal scanning period to the signal line corresponding to the color to be displayed first during the line display period.

4. An image display panel having a group of pixels arranged in a matrix in a predetermined array and assigned to three primary colors, and having a signal line connected for each column of the group of pixels, wherein pixel data of three primary colors are successively supplied for each color to a corresponding signal line during a period excluding a blanking period of one horizontal scanning period constituted by a line display period for the color display of one pixel line, and wherein the image display panel is provided with a precharging control circuit, and the precharging control circuit is connected to a select switch connected to each of the signal lines, supplies permission pulses for the supply of data to signal lines when making them display one color among three primary colors in the line display period to the select switch of the corresponding signal line to turn the same on, turns on the select switch of the signal line corresponding to another color to be displayed later in the same line display period during a period of supply of permission pulses of the supply of data with a precharge pulse having a time duration shorter than the supply time of the pixel data of the other color, and precharges the signal line of the other color in advance to a predetermined potential.

5. A panel drive device for successively supplying pixel data of three primary colors for each color to a corresponding signal line of an image display panel having a group of pixels arranged in a matrix in a predetermined array and assigned to three primary colors and having the signal line connected for each column of the group of pixels during a period excluding a blanking period of one horizontal scanning period constituted by a line display period at the time of driving each pixel line, the panel drive device having a built-in precharging control circuit, and wherein the precharging control circuit is connected to a select switch connected to each of the signal lines, supplies permission pulses for the supply of data to signal lines when displaying one color among three primary colors in the line display period to the select switch of the corresponding signal line to turn the same on, turns on the select switch of the signal line corresponding to another color to be displayed later in the same line display period during a period of supply of permission pulses of the supply of data with a precharge pulse having a time duration shorter than the supply time of the pixel data of the other color, and precharges the signal line of the other color in advance to a predetermined potential.

6. A method of driving an image display panel for successively supplying pixel data of three primary colors for each color to a corresponding signal line of an image display panel having a group of pixels arranged in a matrix in a predetermined array and assigned to three primary colors and having the signal line connected for each column of the group of pixels during a period excluding a blanking period of one horizontal scanning period constituted by a line display period for color display for each pixel line, comprising supplying permission pulses for the supply of data to signal lines when making them display one color among three primary colors in the line display period to the select switch of the corresponding signal line to turn the same on and turning on the select switch of the signal line corresponding to another color to be displayed later in the same line display period during a period of supply of permission pulses of the supply of data with a precharge pulse having a time duration shorter than the supply time of the pixel data of the other color so as to precharge the signal line of the other color in advance to a predetermined potential.

7. The method of driving an image display panel as set forth in claim 6, further comprising changing the time duration or number of the precharge pulses to increase the time of the precharge the shorter the time duration of the permission pulse for the supply of data and the later the display of the color in the line display period.

8. The method of driving an image display panel as set forth in claim 6, further comprising supplying the precharge pulse for the precharge in the blanking period located in the head portion of one horizontal scanning period to the signal line corresponding to the color to be displayed first during the line display period.

* * * * *